US011781545B2

(12) United States Patent
Christov

(10) Patent No.: US 11,781,545 B2
(45) Date of Patent: Oct. 10, 2023

(54) HELICAL SPINDLE PUMP WITH A SINGLE-ENTRY DESIGN

(71) Applicant: Jung & Co. Geratebau GmbH, Kummerfeld (DE)

(72) Inventor: Weshen Christov, Porta Westfalica (DE)

(73) Assignee: Jung & CO. Geratebau GMBH, Kummerfeld (DE)

( * ) Notice: Subject to any disclaimer, the term of this patent is extended or adjusted under 35 U.S.C. 154(b) by 0 days.

(21) Appl. No.: 17/747,674

(22) Filed: May 18, 2022

(65) Prior Publication Data

US 2022/0381241 A1 Dec. 1, 2022

(51) Int. Cl.

| | |
|---|---|
| ***F04B 39/06*** | (2006.01) |
| ***F04B 53/08*** | (2006.01) |
| ***F04C 29/04*** | (2006.01) |
| ***F04C 18/02*** | (2006.01) |
| ***F04C 2/16*** | (2006.01) |
| ***F04C 15/00*** | (2006.01) |
| ***F04C 18/16*** | (2006.01) |

(52) U.S. Cl.

CPC ..... *F04C 2/16* (2013.01); *F04C 15/0003* (2013.01); *F04C 18/16* (2013.01); *F04C 2240/30* (2013.01); *F04C 2240/50* (2013.01)

(58) Field of Classification Search

CPC ..... F04C 2/16; F04C 2/165; F04C 15/0003; F04C 15/0042; F04C 18/16

See application file for complete search history.

(56) References Cited

U.S. PATENT DOCUMENTS 2,590,561 A * 3/1952 Montelius ..... F04C 15/0042 418/203
2,924,181 A * 2/1960 Sennet ..... F04C 15/0042 406/96
5,533,887 A * 7/1996 Maruyama ..... F04C 27/004 418/201.3

FOREIGN PATENT DOCUMENTS

DE 3920901 A1 2/1995
DE 102012001700 A1 9/2013
DE 102013102032 A1 9/2014

* cited by examiner

*Primary Examiner* — Deming Wan
(74) *Attorney, Agent, or Firm* — Mark Rodgers

(57) ABSTRACT

The invention relates to a dual-spindle helical spindle pump with a single-entry design, comprising a pump housing (11) which has a pump portion (12), a bearing portion (13) and a gear portion (14) with a gear chamber, wherein the bearing portion (13) and the pump portion (12) are designed separately from one another, comprising a feed housing part (50) as a component of the pump portion (12) in which two feed screws (17, 18) are provided, said feed screws having flanks (46) and being arranged on shafts (15, 16) in a feed space (51), wherein the shafts (15, 16) are mounted in the bearing portion (13) (external bearing system) and extend into the gear portion (14), and wherein the feed housing part (50) has at least one feed portion (52) with an inner wall (58) which faces the outer face (59) of the feed screws (17, 18). The invention provides that at least one separating element (60), which is in contact with at least one portion of the outer face (59) of the feed screws (17, 18), is between the inner wall (58) of the feed portion (52) and the outer face (59) of the feed screws (17, 18), at least in the region (57) of the feed screws (17, 18), and in that the separating element (60) is floatingly mounted in the feed housing part (50) relative to the inner wall (58) of the feed portion (52).

9 Claims, 4 Drawing Sheets

HELICAL SPINDLE PUMP WITH A SINGLE-ENTRY DESIGN

Figure 1:
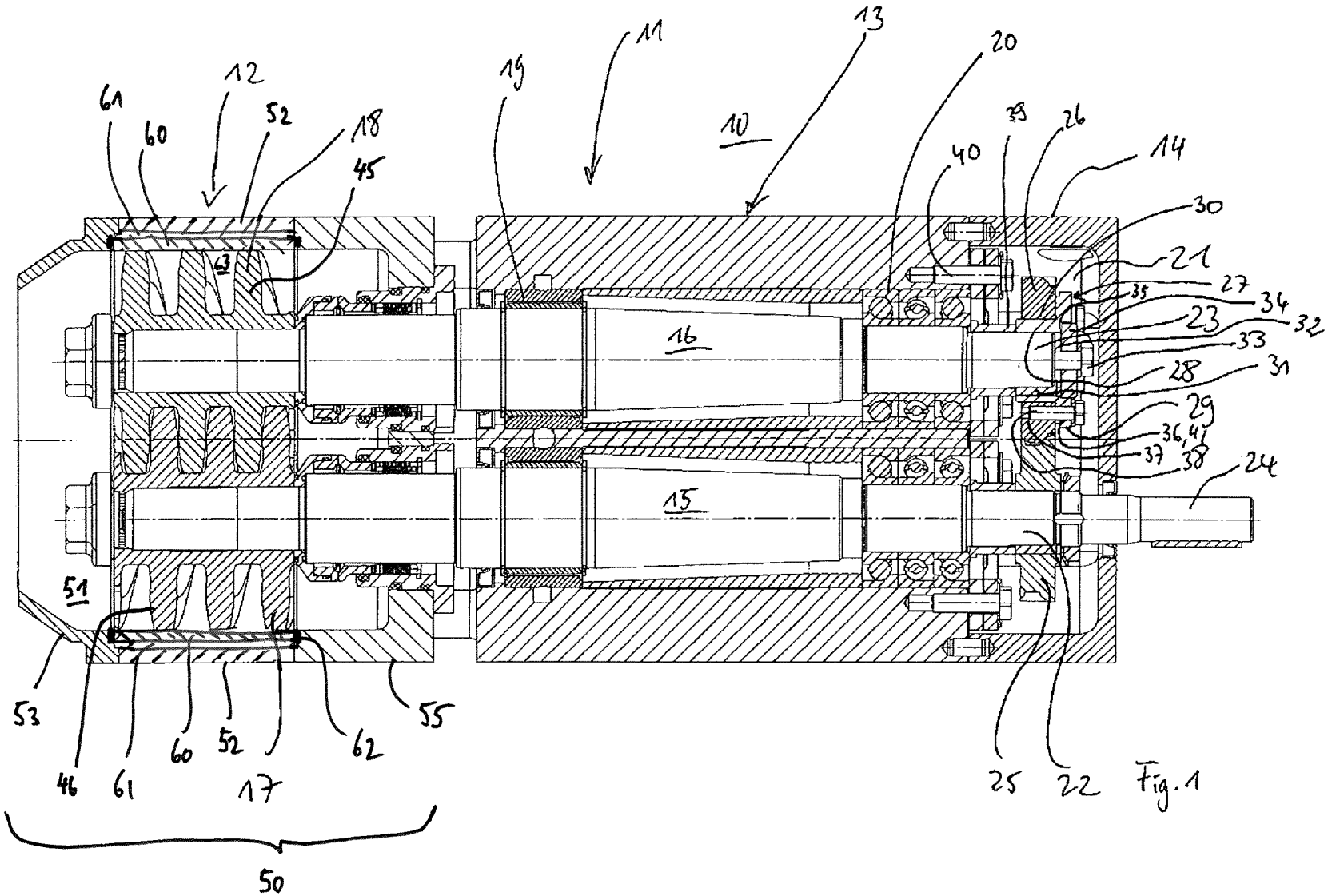

The invention relates to a dual-spindle helical spindle pump with a single-entry design, comprising a pump housing which has a pump portion, a bearing portion and a gear portion with a gear chamber, wherein the bearing portion and the pump portion are designed separately from one another, comprising a feed housing part as a component of the pump portion in which two feed screws are provided, said feed screws having flanks and being arranged on shafts in a feed space, wherein the shafts are mounted in the bearing portion (external bearing system) and extend into the gear portion, and wherein the feed housing part has at least one feed portion with an inner wall which faces the outer face of the feed screws.

Such a pump design is disclosed in DE 2009014604 U1. These pumps are characterized, in particular, by an operation which protects the product and by the low wear associated therewith.

During the operation of the helical spindle pump, radial forces act on the feed screws, said radial forces leading to a deflection of the shafts. The deflection may take place radially upwardly or radially downwardly depending on the feed direction. In order to ensure a contactless operation of the helical spindle pump, a gap is provided between the outer wall of the feed screw and the inner wall of the feed housing which is greater than the deflection of the shafts. However, the gap causes an internal return flow of the medium to be pumped and thus a loss of efficiency. Moreover, the permitted pressure difference of the pump is limited in order to avoid a contact of the outer wall of the feed screw with the inner wall of the feed housing.

The object of the invention is to improve the aforementioned helical spindle pump such that the aforementioned drawbacks are reduced.

The object is achieved in that at least one separating element which is in contact with at least one portion of the outer face of the feed screws is provided between the inner wall of the feed portion and the outer face of the feed screws, at least in the region of the feed screws, and in that the separating element is floatingly mounted in the feed housing part relative to the inner wall of the feed portion.

As a result, it is possible to reduce or even eliminate the spacing between the inner wall and the outer face of the feed screws. It has been shown that if the shafts deform under load, the separating element on the deflection side is displaced by the floating bearing toward the inner wall, whilst on the opposing side the separating element is moved away from the inner wall. As a result, the outer faces of the feed screws, for example, remain in contact with the separating element over the entire surface without a point load being produced, with the corresponding wear, on the outer faces of the feed screws and/or on the inner wall of the feed portion, or without a gap being produced or enlarged between the outer faces of the feed screws and/or on the inner wall of the feed portion, resulting in losses being produced.

A further teaching of the invention provides that a space is provided between the at least one separating element and the inner wall of the feed portion, at least one part of the separating element being movable into and/or out of said space. As a result, the floating bearing may be provided in a particularly simple manner.

A further teaching of the invention provides that the separating element is able to be radially elastically deformed and/or radially moved at least in some portions, when viewed from the central axis of the helical spindle pump parallel to the shafts. As a result, the movement of the separating element together with the outer face of the feed screw toward, or away from, the inner wall of the feed portion is facilitated in a simple manner.

A further teaching of the invention provides that the separating element at least partially consists of at least a plastics material, a ceramic material or a material which does not react in a corrosive manner with the material of the outer face of the feed screws, for example a metal alloy which does not react in a corrosive manner on the stainless steel of the feed screw. Preferably, the plastics material is food-safe. Moreover, the plastics material is preferably low in abrasion. An advantageous embodiment in this case provides that the plastics material is a polyether ether ketone (PEEK).

A further teaching of the invention provides that the feed housing part has a cover with a first feed opening for the connection of a line for supplying or removing a medium to be pumped, and that the cover is connected to the feed portion, and/or that the feed housing part has an intermediate flange with a second feed opening for the connection of a first line for supplying or removing a medium to be pumped, and that the intermediate flange is connected to the feed portion. In this case, it is advantageous if at least one seal is provided in each case between the separating element and the cover and/or the intermediate flange. It is also advantageous if the separating element is floatingly mounted between the seals. As a result, the floating bearing may be provided in a simple manner.

A further teaching of the invention provides that in each case the feed portion has at least one seal at the ends thereof, the separating element being floatingly mounted therebetween. As a result, the floating bearing may be provided in a simple manner.

A further teaching of the invention provides that the separating element is floatingly mounted in the feed housing part relative to the inner wall of the feed portion such that the separating element is rotatably mounted about a rotational axis, wherein the rotational axis is provided at right-angles to the central axis of the helical spindle pump parallel to the shafts. This is preferably implemented between the above-described seals in which the separating element is provided to be movable in order to provide the rotational movement. As a result, the floating bearing may be provided in a simple manner. Moreover, the outer faces of the feed screws, for example, remain in contact with the separating element over the entire surface without a point load being produced, with the corresponding wear, on the outer faces of the feed screws and/or on the inner wall of the feed portion, or without a gap being produced or enlarged between the outer faces of the feed screws and/or on the inner wall of the feed portion, resulting in losses being produced in turn if the deflection increases in a linear manner.

Figure 2:
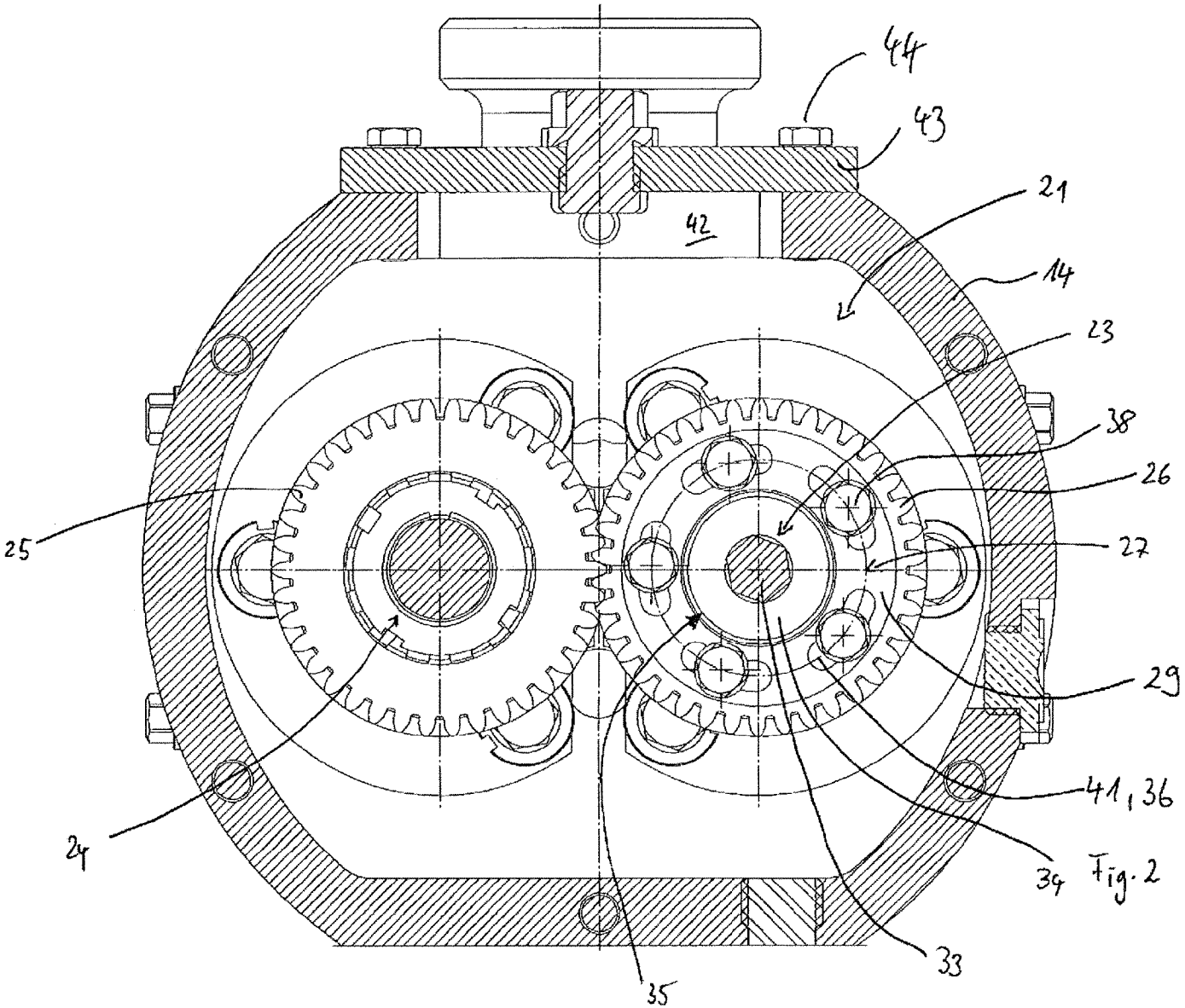
Figure 3:
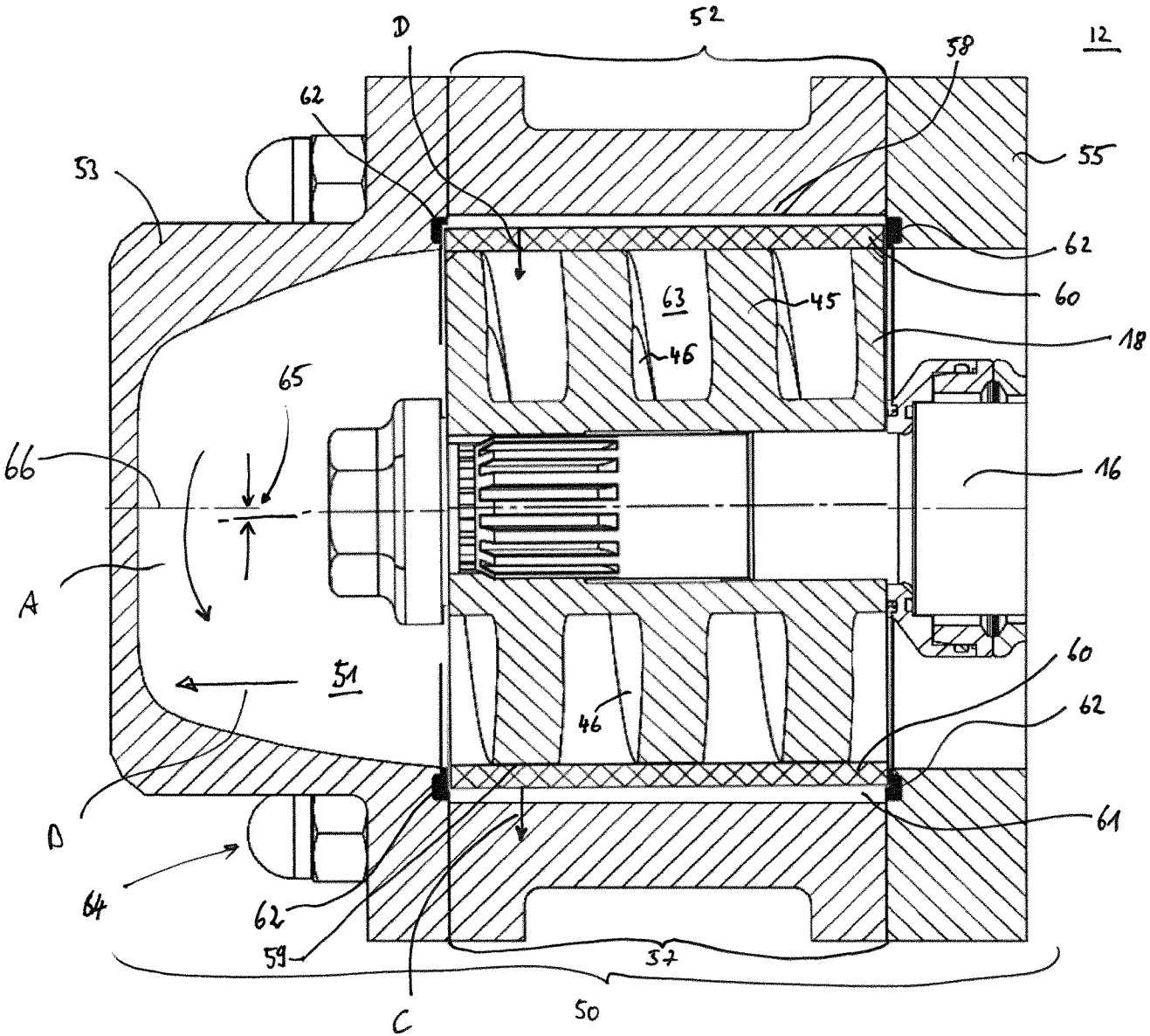
Figure 4:
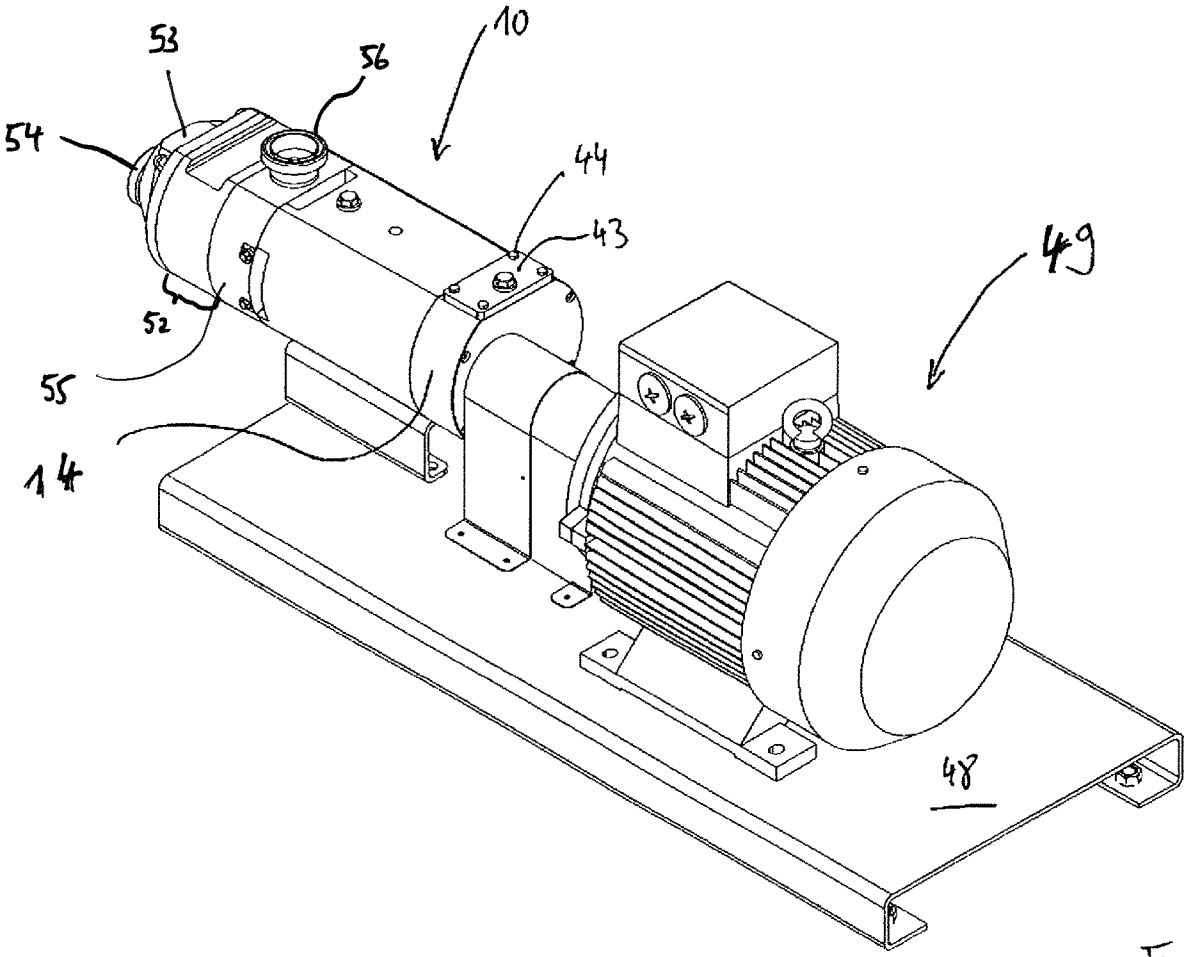

The invention is described hereinafter with reference to an exemplary embodiment in connection with a drawing. In the drawing:

FIG. 1 shows a sectional view through a pump according to the invention in plan view, FIG. 2 shows a sectional view of a pump according to the invention in a sectional view through the gear portion, FIG. 3 shows a sectional view through a pump according to the invention in side view, FIG. 4 shows a three-dimensional view of a pump according to the invention with the drive.

FIG. 1 shows a sectional view in plan view of a spindle pump 10 according to the invention. The spindle pump 10 has a housing 11 which has a pump portion 12, a bearing portion 13 and a gear portion 14. These portions are spatially and hydraulically separated from one another. FIG. 3 shows a sectional view of the pump portion 12 of the spindle pump 10 according to the invention in side view.

The spindle pump 10 comprises a driven shaft 15 and a driven shaft 16. A feed screw 17 is arranged on the driven shaft 15 and a feed screw 18 is arranged on the driven shaft 16, said feed screws being in engagement with one another. A needle bearing 19 and a rolling bearing 20 are provided in the bearing portion 13 so that the shafts are mounted in the external bearing system outside the pump portion 12.

The shaft ends 22, 23 are located in the gear chamber 21. The shaft end 22 of the driven shaft 15 extends out of the housing 11 and has a connection 24 at that point for a drive unit 49.

A gearwheel 25 is located on the driven shaft 15. A gearwheel 26 is arranged on the driven shaft. The teeth of the gearwheels 25, 26 are in meshing engagement.

At the shaft end 23 a fastening element 27 is arranged on the driven shaft 16. The fastening element 27 has a bushing portion 28 and a flange portion 29. The outer face of the bushing portion 28 is at the same time a receiving surface 30 for the gearwheel 26.

A feather key 31 is inserted into a groove (not shown) in the shaft end 23 and in the fastening element 27, a rotational operative connection being produced thereby between the shaft 16 and the fastening element 27. A hexagon bolt 33 is screwed into a bore (not shown) in the front face 32 of the shaft end 23, a clamping washer 34 being tightly screwed thereby against a seat 35 on the fastening element 27. As a result, the fastening element 27 is connected in a locking manner to the shaft end 23.

The flange portion 29 has a bore 36. The gearwheel 26 has a corresponding bore 37 which may be designed as a through-bore or as a bore hole. A thread (not shown) is arranged in the bore 37. A hexagon bolt 38 is screwed into this thread, whereby the flange portion 29 of the fastening element 27 is locked to the gearwheel 26.

A spacer bushing 39 is located downstream of the bushing portion 28 of the fastening element 27, it being ensured thereby that the gearwheel 26 is not able to come into contact with the bearing portion 13 via the fastening screws 40 of the gear portion 14.

The fastening element 27 is shown with its flange portion 29 on the gearwheel 26. The clamping washer 34 is mounted via the hexagon bolt 33 in the seat 35 of the flange portion 29. The bore 36 in the flange portion 29 is designed in this case as a slot 41. Moreover, the gear portion 14 has on its upper face an opening 42 which is retentively connected by a cover 43 via hexagon bolts 44 to the gear portion 14 (see FIG. 2).

FIG. 3 shows a sectional view through a preferred embodiment of a helical spindle pump according to the invention in side view.

The pump portion 12 in this case has a feed housing part 50. A feed space 51, in which the feed screws 17, 18 are provided in corresponding bores, is arranged in the feed housing part 50. The feed housing part 50 in this case is composed of a feed portion 52, a cover 53 with a first feed opening 54 and an intermediate flange 55 with a second feed opening 56. These components are screwed together with a nut-screw connection 64, as is preferably shown here.

Feed chambers 63, in which the material to be pumped is moved, are provided between the individual feed screw projections 45.

In each case, a seal 62 is provided between the feed portion 52 and the cover 53 or between the feed portion 52 and the intermediate flange 55.

In the embodiment shown in FIG. 3, the seals 62 are shown such that these seals are arranged on the cover 53 and on the intermediate flange 55 toward the feed portion 52.

However, the seals 62 may also extend further toward the feed portion 52.

A separating element 60, which is separated from an inner wall 58 of the feed portion 52 by a space 61, is provided in the region of the seal 62.

The separating element 60 in this case is preferably provided over the entire region 57 of the feed screws 17, 18.

In this case the separating element 60 is arranged so as to be movable, in conjunction with the seals 62 and relative thereto, into the space 61 or out of said space. A floating bearing system is present between the separating element 60 in the feed space 51. In this case the movement may take place radially, for example relative to a central axis 66.

In FIG. 3 the feed direction is shown in the direction of the arrow B. During operation, the shafts 15, 16 are deflected in the direction of the arrow A toward the lower inner wall 58, so that a deflection 65 is produced relative to the central axis 66 of the shafts 15, 16.

The outer face 59 of the feed screws 17, 18 are in contact with the separating element 60.

By the deflection in the direction of the arrow A, the separating element 60 moves in the direction of the arrow C into the space 61 toward the inner wall 58 of the feed portion 52 on the lower face of the feed screws 17, 18. At the same time, the separating element 60 moves on the upper face of the feed screws 17, 18 out of the space 61 in the direction of the arrow D. The movement of the separating element 60 thus preferably takes place radially relative to the central axis 66. The contact between the outer faces 59 of the feed screws 17, 18 and the separating element 60 is maintained, so that a gap is not produced between the outer face 59 and the separating element 60, so that no losses occur due to return flows during the pumping operation.

In this case, the separating element 60 also moves at least relative to the seal 62 between the cover 53 and the feed portion 52 in the direction of the arrow C or in the direction of the arrow D.

Depending on the deformation of the shafts 15, 16 or feed screws 17, 18 the separating element 60 is also potentially elastically deformed therewith. If the deformation of the shafts 15, 16 or feed screws 17, 18 is linear, then an elastic deformation of the separating element 60 is not required.

Alternatively or additionally, a rotational movement may also take place about a rotational axis, not shown, whereby either a movement of the separating element 60 takes place relative to the seal 62 between the cover 53 and the feed portion 52 in the direction of the arrow C, D, or additionally a movement of the separating element 60 also takes place relative to the seal 62 between the feed portion 52 and the intermediate flange 55 counter to the direction of the arrow C, D.

FIG. 4 shows an arrangement of the spindle pump 10 on a base plate 48. The spindle pump 10 in this case is connected to a drive unit 49.

LIST OF REFERENCE NUMERALS

10 Spindle pump
11 Housing
12 Pump portion
13 Bearing portion

14 Gear portion
15 Driven shaft
16 Driven shaft
17 Feed screw
18 Feed screw
19 Needle bearing
20 Rolling bearing
21 Gear chamber
22 Shaft end
23 Shaft end
24 Connection
25 Gearwheel
26 Gearwheel
27 Fastening element
28 Bushing portion
29 Flange portion
30 Receiving surface
31 Keyway
32 Front face
33 Hexagon bolt
34 Clamping washer
35 Seat
36 Bore
37 Bore
38 Hexagon bolt
39 Spacer bushing
40 Fastening screw
41 Slot
42 Opening
43 Cover
44 Hexagon bolt
45 Screw projection
46 46 Flank
47 Flank clearance
48 Base plate
49 Drive unit
50 Feed housing part
51 Feed space
52 Feed portion
53 Cover
54 First feed opening
55 Intermediate flange
56 Second feed opening
57 Region of feed screws
58 Inner wall
59 Outer face
60 Separating element
61 Space
62 Seal
63 Feed chamber
64 Nut-screw connection
65 Deflection
66 Central axis
A Direction of deflection
B Feed direction
C Floating movement
D Floating movement

The invention claimed is:

1. Dual-spindle helical spindle pump with a single-entry design, including a pump housing with a pump portion, a bearing portion, and a gear portion with a gear chamber, wherein the bearing portion and the pump portion are separated from one another, the pump portion including a feed housing in which two feed screws are provided, the feed screws having flanks and arranged on shafts in a feed space, wherein the shafts are mounted in the bearing portion and extend into the gear portion, and wherein the feed housing part has at least one feed portion with an inner wall which faces outer face of the feed screws, the spindle pump comprising;

at least one separating element disposed between the inner wall of the feed portion and at least one portion of the outer face of the feed screws, wherein the at least one separating element is in contact with the at least one portion of the outer face of the feed screws, and wherein the separating element is floatingly mounted in the feed housing part relative to the inner wall of the feed portion.

2. The Dual-spindle helical spindle pump according to claim 1, comprising a space between the at least one separating element and the inner wall of the feed portion, wherein at least one part of the separating element is movable into and out of the space.

3. The Dual-spindle helical spindle pump according to claim 1, wherein the separating element is at least one of radially elastically deformable or radially movable at least in some portions, relative to a central axis of the helical spindle pump parallel to the shafts.

4. The Dual-spindle helical spindle pump according to claim 1, wherein the separating element at least partially consists of at least a plastics material, a ceramic material or a material which does not react in a corrosive manner with the material of the outer face of the feed screws.

5. The Dual-spindle helical spindle pump according to claim 1, wherein the feed housing part comprises a cover with a first feed opening for the connection of a first line for supplying or removing a medium to be pumped, and the cover is connected to the feed portion, and wherein the feed housing part comprises an intermediate flange with a second feed opening for the connection of a second line for supplying or removing a medium to be pumped, and the intermediate flange is connected to the feed portion.

6. The Dual-spindle helical spindle pump according to claim 5, comprising at least one seal between the separating element and at least one of the cover or the intermediate flange.

7. The Dual-spindle helical spindle pump according to claim 6, wherein the separating element is floatingly mounted between the seals.

8. The Dual-spindle helical spindle pump according to claim 1, wherein the feed portion has at least one seal at the ends thereof, and the separating element is floatingly mounted therebetween.

9. The Dual-spindle helical spindle pump according to claim 1, wherein the separating element is floatingly mounted in the feed housing part relative to the inner wall of the feed portion wherein the separating element is rotatably mounted about a rotational axis, wherein the rotational axis is provided at right-angles to a central axis of the helical spindle pump parallel to the shafts.

* * * * *